US011026854B2

(12) United States Patent
Visco

(10) Patent No.: US 11,026,854 B2
(45) Date of Patent: Jun. 8, 2021

(54) PATIENT STABILIZATION, INFECTION BARRIER, PRESSURE ULCER PREVENTION AND EQUIPMENT PROTECTION DEVICE AND METHODS OF USE

(71) Applicant: Anthony G. Visco, Chapel Hill, NC (US)

(72) Inventor: Anthony G. Visco, Chapel Hill, NC (US)

( * ) Notice: Subject to any disclaimer, the term of this patent is extended or adjusted under 35 U.S.C. 154(b) by 0 days.

(21) Appl. No.: 16/448,863

(22) Filed: Jun. 21, 2019

(65) Prior Publication Data

US 2019/0307626 A1 Oct. 10, 2019

Related U.S. Application Data

(63) Continuation of application No. PCT/US2017/068184, filed on Dec. 22, 2017.
(Continued)

(51) Int. Cl.
*A61G 13/12* (2006.01)
*A61G 7/057* (2006.01)
*A61G 13/10* (2006.01)

(52) U.S. Cl.
CPC ..... *A61G 13/123* (2013.01); *A61G 7/05707* (2013.01); *A61G 13/126* (2013.01);
(Continued)

(58) Field of Classification Search
CPC ..... A61G 13/0009; A61G 13/0018; A61G 13/0027; A61G 13/0036; A61G 13/0045;
(Continued)

(56) References Cited

U.S. PATENT DOCUMENTS 2,258,782 A 10/1941 Mckean
2,605,152 A * 7/1952 Krewson ..... A61G 13/12 5/646

(Continued)

FOREIGN PATENT DOCUMENTS

WO WO-2011/007345 A1 1/2011
WO WO-2014/176418 A2 10/2014
WO WO-2018/119394 A1 6/2018

OTHER PUBLICATIONS

Extended European Search Report issued by the European Patent Office in corresponding Application No. EP 19156781 dated Jul. 17, 2019.

(Continued)

*Primary Examiner* — Robert G Santos
*Assistant Examiner* — Ifeolu A Adeboyejo
(74) *Attorney, Agent, or Firm* — Foley Hoag LLP; Stephen J. Kenny

(57) ABSTRACT

The present disclosure provides a patient positioning device and methods of using such a device that allows for the easy securing of the device to the operating room table or hospital bed, a comfortable surface for patients to rest on during their diagnostic, therapeutic or surgical procedure, that helps reduce the likelihood of developing pressure ulcers, protects the patient by providing an infectious barrier, helps protects the patient from electrical injury by creating a non-conductive barrier between the patient the metal operating table, and protects the operating room table and equipment with an integrated, impermeable barrier to prevent blood, other bodily fluids and other fluids such as intravenous fluids, blood products and irrigation from soiling the operating or procedure table and nearby equipment. The device overcomes several challenges that exist with current devices and methods and is simple, disposable, and cost-effective. It allows for easier, faster and safer patient positioning,
(Continued)

improved infection control, lower risk of electrical injury, improved protection from pressure ulcer formation, less waste compared to current options in a single, one-package solution. Additionally, a leg portion of the device can include an inflatable member which serves as a Sequential Compression Device which can be repeatedly inflated/deflated to facilitate circulation and prevent formation of blood clots.

12 Claims, 6 Drawing Sheets

Related U.S. Application Data

(60) Provisional application No. 62/438,884, filed on Dec. 23, 2016.

(52) U.S. Cl.
CPC ..... *A61G 13/1285* (2013.01); *A61G 13/101* (2013.01); *A61G 13/129* (2013.01); *A61G 13/1235* (2013.01); *A61G 13/1295* (2013.01); *A61G 2210/70* (2013.01); *A61G 2210/90* (2013.01)

(58) Field of Classification Search
CPC ..... A61G 13/0072; A61G 13/009; A61G 13/105; A61G 13/12; A61G 13/1235; A61G 13/124; A61G 13/1255
See application file for complete search history.

(56) References Cited

U.S. PATENT DOCUMENTS

D170,305 S 9/1953 Clans
3,156,500 A 11/1964 Kerr
3,227,440 A * 1/1966 Scott ..... A61G 13/12 5/618
D245,287 S 8/1977 Damico et al.
D248,406 S 7/1978 Hodge
D260,172 S 8/1981 Kyle
4,620,337 A * 11/1986 Williams ..... A61G 7/05707 5/691
D304,614 S 11/1989 Guttormsen
D324,103 S 2/1992 Masuda et al.
D344,802 S 3/1994 Kuck et al.
5,546,963 A 8/1996 Doody
5,549,121 A 8/1996 Vinci
5,606,755 A * 3/1997 Romein ..... A47B 3/087 5/306
5,742,963 A * 4/1998 Trevino ..... A61G 1/00 128/845
5,785,057 A 7/1998 Fischer
5,785,716 A 7/1998 Bayron et al.
D403,772 S 1/1999 Fanuzzi
D409,751 S 5/1999 Kemp
6,227,201 B1 5/2001 Ferko, III
6,260,220 B1 7/2001 Lamb et al.
6,308,353 B1 10/2001 Van Steenburg
6,578,219 B1 * 6/2003 Gabel ..... A61G 7/05715 5/600
7,216,385 B2 5/2007 Hill
7,287,289 B1 * 10/2007 Hagopian ..... A61G 7/05769 5/600
D604,421 S 11/2009 Albrecht et al.
7,636,967 B1 12/2009 Stokes
8,156,941 B1 4/2012 Simms
8,171,585 B2 * 5/2012 Mead ..... A41D 31/28 5/655.4
8,342,603 B2 * 1/2013 Leeds ..... G06Q 30/0635 297/229
D770,049 S 10/2016 Yanagihara
D851,258 S 6/2019 Visco
10,512,578 B2 12/2019 Visco
2004/0068797 A1 4/2004 Smith et al.
2004/0074003 A1 4/2004 Bannister
2004/0128774 A1 * 7/2004 Chen ..... A61G 13/121 5/740
2005/0125896 A1 6/2005 Cavalier et al.
2006/0112490 A1 * 6/2006 Chausse ..... A47C 20/026 5/690
2006/0260053 A1 * 11/2006 Roleder ..... A47B 3/0912 5/620
2007/0022535 A1 2/2007 Yue
2007/0056105 A1 3/2007 Hyre et al.
2007/0059123 A1 3/2007 Tangeman et al.
2008/0178390 A1 7/2008 DuDonis
2009/0049603 A1 2/2009 Martin et al.
2010/0235995 A1 9/2010 Liang
2010/0275377 A1 11/2010 West
2010/0305431 A1 12/2010 Crisco et al.
2011/0047706 A1 3/2011 Hiebert
2011/0195374 A1 8/2011 Boren
2011/0247612 A1 10/2011 DeSalvo
2011/0296609 A1 12/2011 Giap
2012/0110742 A1 5/2012 Lawler et al.
2013/0174853 A1 7/2013 Pigazzi et al.
2013/0312189 A1 11/2013 Sarma et al.
2014/0359941 A1 12/2014 Sharps et al.
2015/0297435 A1 10/2015 Visco
2016/0095537 A1 4/2016 Epstein
2016/0279007 A1 * 9/2016 Flatt ..... A61G 13/126
2020/0078248 A1 3/2020 Visco

OTHER PUBLICATIONS

International Search Report and Written Opinion for International Application No. PCT/US17/68184 dated Mar. 9, 2018.
International Search Report from related international application PCT/US2014/035286, dated Apr. 2, 2015.
Extended European Search Report for EP Application No. 17882853.9 dated Jun. 18, 2020.

* cited by examiner

PATIENT STABILIZATION, INFECTION BARRIER, PRESSURE ULCER PREVENTION AND EQUIPMENT PROTECTION DEVICE AND METHODS OF USE

CROSS-REFERENCE TO RELATED APPLICATIONS

This application is a Continuation of and claims the benefit of priority under 35 USC 120 to PCT/US17/68184 filed Dec. 22, 2017, which claims the benefit of priority under 35 USC 119 to U.S. Provisional Application No. 62/438,884 filed Dec. 23, 2016, the entire contents of each are incorporated herein.

FIELD OF THE INVENTION

The present disclosure relates to the field of surgery, and more particularly to a device, and methods of using such a device, to position and/or stabilize a patient during a surgical procedure.

BACKGROUND

The present invention relates to a positioning system for positioning a person on a surgical table, comprising a mattress set with one or more layers of foam and a protective barrier. The invention helps to facilitate surgical procedures performed by a variety of surgical services including but not limited to general surgery, trauma, neurosurgery, vascular surgery, cardiothoracic surgery, colorectal surgery, obstetrical surgery, gynecologic surgery, and urologic surgery in the supine, prone and lateral positions. The unique features included provide for ease of use, reduction in the risk of infection, reduction in the risk of electrical injury, and reduction in the risk of pressure ulcers. The present invention also has the ability to reduce the risk of damage to and soiling of the operating table, accessories and nearby equipment particularly during surgeries that result in large volumes of bodily fluid loss including blood loss or large amounts of other fluid such as intravenous fluid, irrigation fluid or blood products.

Currently, the patient is typically placed on the operating table with only a thin sheet of various material between the patient's skin and the operating table. During surgery, vascular supply can be reduced or otherwise compromised that can lead to pressure ulcer formation. The risk of this is increased due to uneven pressure forces or increased pressure forces such as can happen when soft tissue is compressed between the Operating Room (OR) table surface and bony prominences.

The present invention includes a position system that serves to inhibit decubitus ulcer formation on a person placed in a static position during the surgical procedure. In some embodiments, an impervious barrier is created between the patient and the operating table to keep the operating table clean, minimize the spread of bodily fluids and improve operating room turnover my reducing the time needed to clean and prepare the operating table between surgeries.

Patient positioning is critically important as the patient may spend several hours in a particular position while lying on the surgical table. Patients generally are positioned on pads and cushions such as rolled towels, blankets, gel or foam pads or gel or foam rolls or other space occupying devices. These basic and rudimentary devices are not standardized and may result in uneven pressure distribution that has been associated with the development of pressure ulcers.

The current understanding of pressure ulcer formation is related to poor tissue perfusion for prolonged periods of time leading to ischemia at the capillary level. The development of an intraoperative or post-operative pressure ulcer often results in prolonged pain, suffering and prolonged medical and surgical care and increased cost. The tissue damage may be superficial and resolve with repositioning or may be advanced and severe resulting in death to nearby skin, nerves, muscles, subcutaneous tissue, muscles and even bone.

Another reusable device comprises a gel pad that is placed under the patient. Such devices face similar problems, such as increased risk of infection because the patient's skin is in direct contact with the pad and the device requires additional work/time, including the need to warm the gel pad prior to patient contact.

Other devices exist that have been applied with various adhesives or silicone coating directly to the patient's skin to help prevent ulcer formation. These may actually harm the skin and underlying soft tissue by creating skin breakdown upon removal, may roll during positioning or surgical procedure causing uneven pressure distribution increasing the risk of ulcer formation. Additionally, it is difficult to predict exactly where a pressure ulcer will form as there are several areas along the human body that increased pressure may form that include but are not limited to the sacrum, spine, head, scapula and skull, arms, hands, legs, feet and heels.

Yet another option comprises a foam egg crate positioned between the patient and the operating room table mattress, where the foam egg crate is taped to the operating table. If the foam is cut to generally the size of the bed, taping is relatively straightforward, however, the tape or other strap devices do not provide adequate support or protection to the skin and underlying soft tissue and may create uneven pressure distribution that serves to increase the risk of pressure ulcers. Current devices require additional time and effort. Furthermore, conventional foam layers do not provide the desired infection and contamination protection desired.

Moreover, all of the above-mentioned devices also commonly use wide silk or paper tape. The roll of tape is multi-use and represents an infectious disease risk because the edges of the tape are sticky and the roll is maintained in the operating room (OR) between patients. The use of tape to secure the devices to the operating table creates uneven pressure distribution that may increase the risk of pressure ulcer formation.

Hence, there is a need for an improved device that provides easier, faster and more secure patient positioning, improved infection control, improved protection of the patient's tissue during surgical procedures, keeps the operating table clean during use, protects the mechanical and electrical components of the operating table and improves operating room turnover and efficiency.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION

Figure 1:
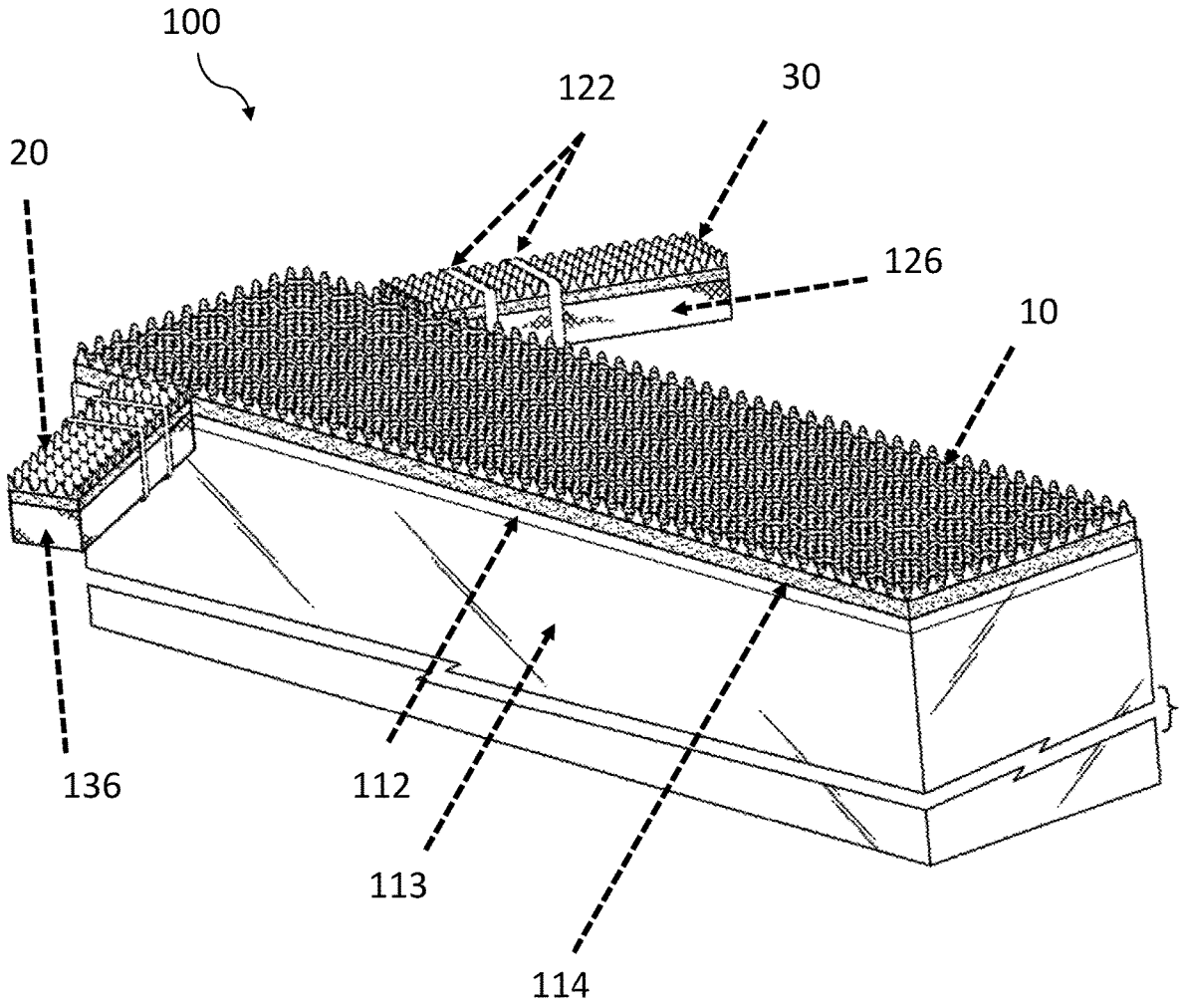
FIG. 1 is a representation of the stabilization device in accordance with the disclosed subject matter.

The present disclosure addresses the previously mentioned shortcomings. In some embodiments, a stabilization device can be an all in one disposable base with a custom design to allow for patient stability and comfort. Other embodiments are a kit of multiple parts. Other embodiments include a method of using such devices or kits.

In some embodiments, the stabilization device includes the general size and shape of the operating room table/bed. In yet other embodiments, the device may be made larger to fit those tables and/or patients that are larger than normal (e.g., obese patients, unusually tall patients, etc.) or to support and protect the arms and hands when positioned at the sides of the patient.

In some embodiments, the stabilization device is composed of a support material selected from the group consisting of one or more spring assemblies, foams, gel pads. In some embodiments, the foam is selected from the group consisting of polyurethane, silicone, vinyl, nylon, polyethylene vinyl acetate (PEVA), and the like. In other embodiments, the support material includes a plurality of pods or chambers that are filled with an incompressible fluid such as water, viscous oil, or some other biocompatible In yet other embodiments, the pods or chambers are filled with a gas air, nitrogen, etc.). Yet in other embodiments the pods or chambers are filled with a fluid, gas or combination thereof. In yet other embodiments, the support material may be filled with a material that can be heated or cooled to help regulate the body temperature of the patient or to specifically heat or cool certain body parts or organs or to change the patient's body temperature.

In some embodiments, the supporting material can have a thickness of at least 0.25", 0.5", 0.75", 1", 2", 4", 5", 6", 7", 8", 9", 10", 11", and 12". In certain embodiments, the support material includes a thickness between 0.5" and 6".

In some embodiments, the back surface of the support material can include a slip-resistant material to provide more precise and secure positioning of the stabilization device on the OR table. In some embodiments, the slip-resistant material is selected from the group consisting of rubber, adhesive tapes and glues, anti-skid materials, fastener/interlocking materials, e.g., hook and loop fasteners, or any other material that tends to increase the friction between the device and the under lying OR table, or mattress, or whatever surface the device is deployed upon. Additionally, or alternatively, the back surface can include OR table registration features (e.g. protruding lip to engage the perimeter of the OR table).

In some embodiments, the stabilizing device can include an infection control barrier material that covers the sides and the base of the table to isolate the patient from the OR table and mattress, and the table and mattress from bodily fluids. In some embodiments, the material is transparent. The barrier can be made of a wide variety of materials, such as plastic, cellophane, nonwoven material, cloth and the like that can prevent the spread of infection from bodily fluids released during a surgical procedure. In some embodiments the infection control barrier can be positioned between adjacent layers of the stabilizing device. Furthermore, the infection control barrier material can be formed with a coupling feature for secure attachment to the support material. For example, the infection control barrier material and support material can be adhesively bonded (wherein at least one of the two components has an adhesive on the surface which mates with the adjacent component). Additionally, or alternatively, the infection control barrier material and support material can be coupled via various mechanical means such as straps, hook and loop fasteners, buttons, snap fasteners, etc.

In some embodiments, the stabilizing device can include at least one fastener means positioned on the backside of the device to secure it to the operating room table. In some embodiments, the device can include at least 2 or 3 fastener means (e.g. along a bottom and/or top surface; extending along a single or both lateral sides of the device). In some embodiments the fastener can be coupled to the device at a position between the two layers (described in more detail below) of the device, such that the fastener is sandwiched therebetween. In some embodiments, the fasteners are positioned at the head portion of the device, the rectangular body portion of the device, the inferior (i.e. foot end) of the device, or combinations thereof. In some embodiments, the fastener means secures the device by fastening to the rails of the operating room table. In other embodiments, the fastener means also help secure the operating room table mattress to the bed. In some embodiments, the fastening means is selected from the group consisting of ties, hook and loop fasteners, adhesive strips, snaps, straps and the like. Additionally, or alternatively, the back surface of the support material can include a slip-resistant material, for example, any biocompatible material that provides friction to help keep the patient in one place when the operating room table is inverted. Such materials include, but are not limited to, rubber, silicone, adhesive tapes and glues, anti-skid materials, fastener/interlocking materials such as hook and loop fasteners, and the like.

In accordance with another aspect of this disclosure, increasing the overall body temperature (hyperthermia) or decreasing the overall body temperature (hypothermia) or increasing or decreasing the temperature of various organs is possible. The goal of this is generally to affect metabolic rate such as cooling a kidney to its reduce metabolic rate and prolong ischemia time and to improve outcomes during renal transplantation. As select regions of the device can be heated/cooled independently of neighboring regions, this allows a global temperature regulation or allow for focused cooling or heating of organs in select location(s).

This disclosure is designed to thermoregulate tissues or organs such as the kidney, through a transcutaneous approach with the goal in cooling or warming the urine or renal vasculature compared to body temperature in an attempt to utilize the temperature gradient created by this minimally invasive approach and to enhance the thermography gradient and improve the detection, identification, localization and resolution of the ureter or renal blood vessels during surgery through an open (laparotomy), laparoscopy, robotic-assisted laparoscopy, ultrasound, Doppler ultrasound, real-time infrared thermography and other procedures that would enhance and improve the correct identification of the ureter.

Such a cooling or heating device could be integrated into the device disclosed herein or be integrated into an operating and procedure table.

In order to change the temperature of the kidney for instance, a temperature control device would be positioned proximate the skin. For instance, the temperature control device would be placed on the back or side of the patient, adjustable to the general location of the kidneys if the kidneys were the desired organ to thermoregulate. This temperature control device could employ a variety of heating and cooling elements that including but not limited to cooling fluid, ice, cold gas, warming fluid, warm gas, warming elements vibratory elements. Other devices that can transmit heat or cold transcutaneously could also be used. In an attempt to avoid increasing or decreasing the patient's overall body temperature, an additional device with fluid or gas that warms if the main device cools and cools if the main device warms may be used. This could serve two purposes, to maintain overall patient thermoregulation and also to further increase the temperature gradient. For instance, a warming pad could be placed along the patients back to warm the posterior surface of the patient and retroperitoneal structures while at the same time cooling the kidney and urine so that when the urine flows inside the ureter, along the retroperitoneum, it would be easier to differentiate from the adjacent tissue. As noted above, the temperature control device(s) employed can provide global thermal regulation of the patient or localized thermal regulation of select regions/organs, as so desired.

In those embodiments incorporating the temperature control device, the body portion of the stabilizing device can define a thermal element retainer and the thermal element can be securely retained in the thermal element retainer. The thermal element retainer can be a pocket, for example a sealable pocket, and/or may be formed by a void or cutout in the body portion. The thermal element can be a heating element or a cooling element. The thermal element may be passive, such as a pack containing compounds undergoing endothermic or exothermic reaction, or the heating element may be actively controlled, as by a thermostatic circuit. The thermal element can be located on the device such that, when the patient is supine on the body portion, and the patient's shoulders are aligned with the superior edge of the body portion, then the thermal element is aligned with a kidney and/or a ureter of the patient.

This external (transcutaneous) regulation of temperature is not limited to the kidney and could be utilized to identify other tissues or structures such as vascular and neural structure both benign and malignant as it may be possible that malignant and benign tissues have a different propensity to absorb or dissipate heat or cold.

In some embodiments of the present disclosure, the support is constructed entirely of a single material. In some such devices the support includes convoluted polyurethane foam. In some embodiments the support is constructed of a plurality of pieces, for example, a plurality of pieces can be two pieces having mirror symmetry, or a piece corresponding to the body portion, a piece corresponding to the head portion and separate pieces for each upper and lower extremity. Each of these pieces may have thermoregulatory capabilities as described herein.

For the purposes of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e. at least one) of the grammatical object of the article. By way of example, "an element" means at least one element and can include more than one element.

FIG. 1 illustrates an exemplary stabilization device (100) having a series of undulating pressure distribution features (i.e. peaks and valleys in this particular embodiment) located across the top surface for receiving a patient. In the embodiment shown, the undulating peaks and valleys are made of a homogenous material and are uniformly distributed about the surface area of the stabilization device, with a uniform height (peak) and depth (valley) however it is to be understood that alternative configurations are within the scope of the present disclosure. The stabilization device (100) can further include patient positioning features (e.g. a relatively concave portion to receive a patient's head, protrusions to abut a patient's shoulders, etc.), if so desired. While the embodiment shown in FIG. 1 depicts a unitary body portion with separate arm portions, other embodiments in which the body portion is comprised of multiple discrete portions.

In some embodiments a subset of the pressure distribution features could be formed from a more rigid material and/or have non-uniform dimensions such that, e.g., the pressure distribution features located in the central portion of the stabilization device (which would align with the patient's torso and thus bear the primary load) compress or deform to a lesser extent than the pressure distribution features located peripheral to the patient's torso.

Figure 2:
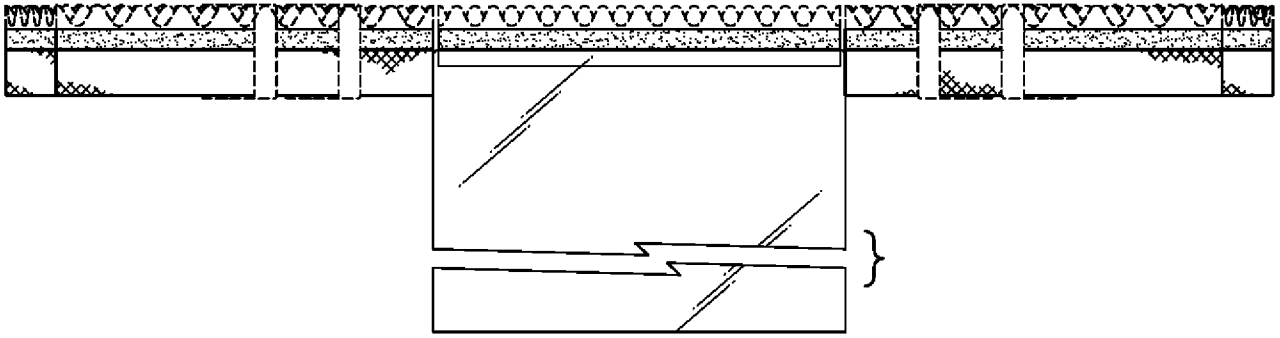
FIG. 2 is a front view of the stabilization device shown in FIG. 1.
Figure 3:
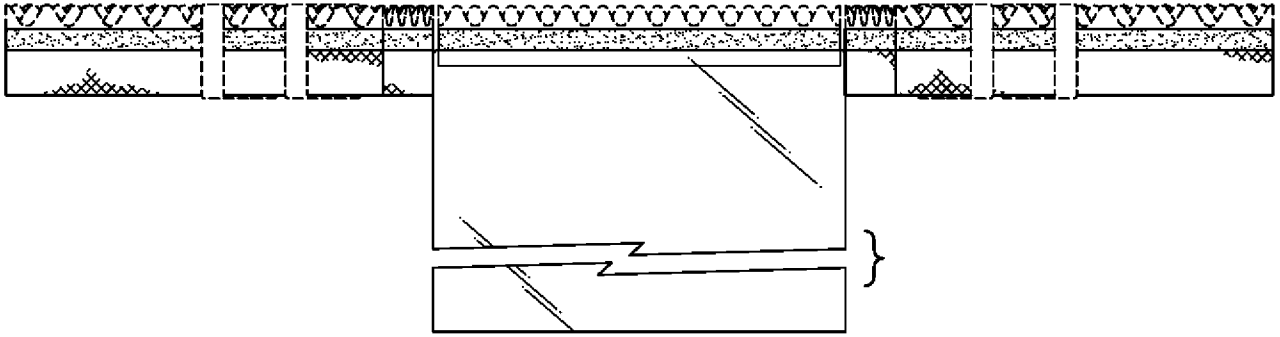
FIG. 3 is a rear view of an arm portion of the stabilization device shown in FIG. 1.
Figure 5:
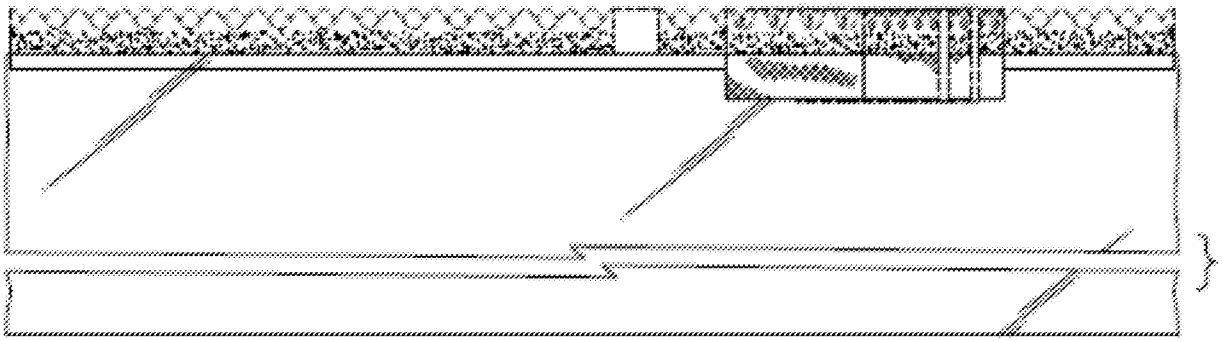
FIG. 5 is right side view of the stabilization device shown in FIG. 1.
Figure 6:
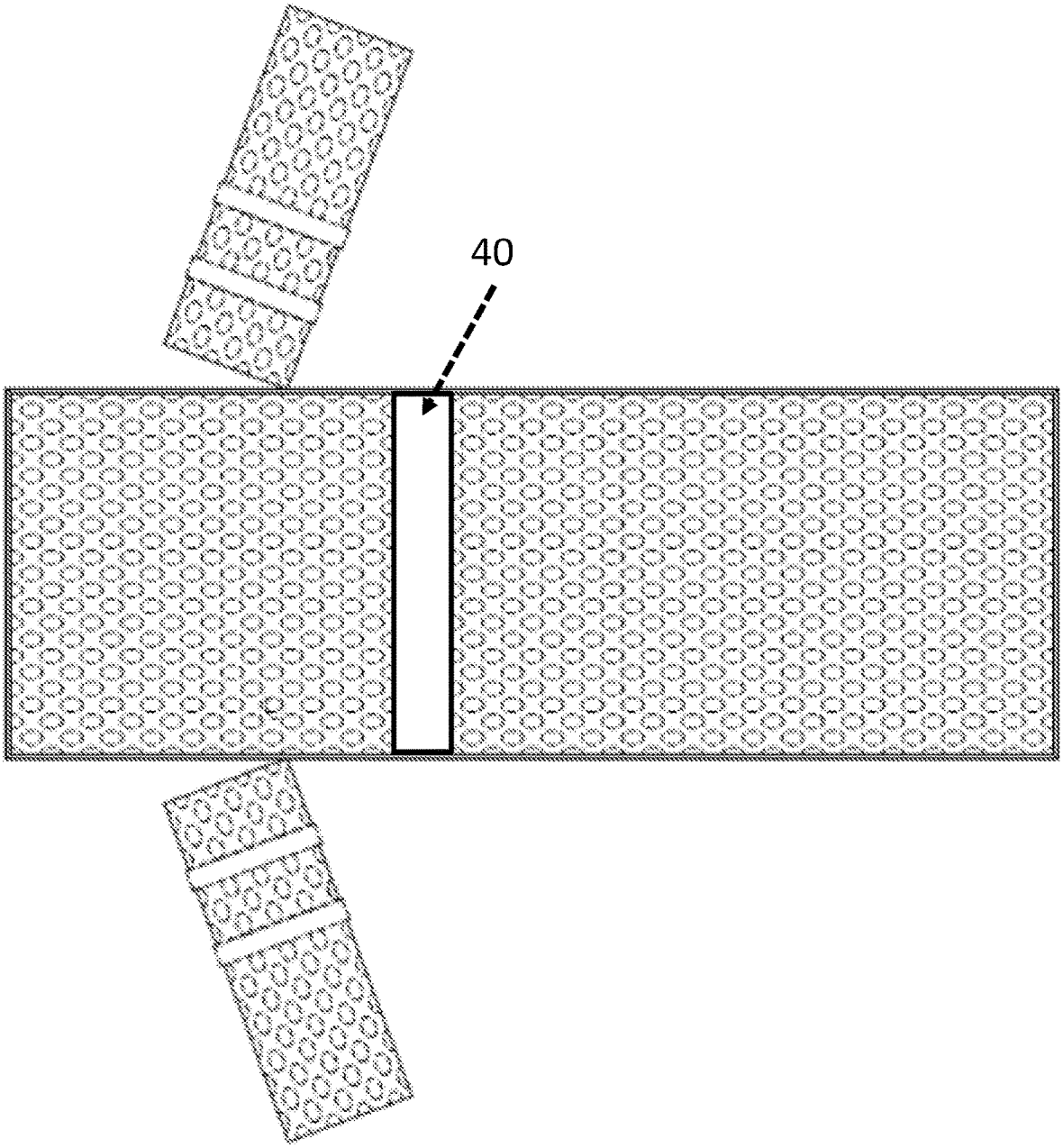
FIG. 6 is a zoom-in view of the arm board portion of the stabilization device shown in FIG. 5.

As shown in FIGS. 1-3, the stabilization device (100) can include a main portion (10) for receiving a patient's body, and two lateral extensions (20, 30) for receiving a patient's arms. These can be formed as integral unit or discrete members which can be coupled together. A flexible material (e.g. elastic band) can be used to couple the discrete pieces (10, 20, 30) together while allowing sufficient relative motion between pieces such that the arm portions can pivot along the range of motion of the OR table arm boards, yet remain attached to the main body portion of the device. The stabilization device (100) can be formed to match any specific OR table dimensions. In some embodiments the stabilization device can be configured with an adjustable length in which a user can unroll the main portion (10) to the desired length and secure any remaining material (in the rolled configuration) via straps (not shown). In some embodiments, the lateral extensions (120, 130) can include an integrally formed sleeve (126, 136) for receiving the OR table arm boards to ensure accurate and secure positioning of the stabilization device, as shown in FIGS. 5-6. The sleeve portion (126, 136) can be formed with different properties (e.g. material, thickness, porosity, etc.) than the pressure distribution (e.g. top foam layer) surface (120, 130). One end of the sleeve can be open so as to form a mouth to receive the OR table arm board upon insertion, with the opposite end being closed such that an OR table arm board can register or abut against the interior surface thereby confirming proper relative positioning to the user (as best shown in FIG. 6). Additionally, the lateral extensions (120, 130) can include a plurality of straps (122, 124, 132, 134) for securing a patient's arms to the OR table (since the OR table can be housed within the sleeve 126, 136). Accordingly, these straps can extend around the entire periphery of the lateral extensions (120, 130), such that the strap does not contact the OR table directly, and include a variety of fastening mechanisms (e.g. hook and loop fasteners) as described herein. Alternatively, the straps can be coupled to the pressure distribution (e.g. top foam layer) surface of the lateral extension (120, 130) or directly to the OR table arm board, if so desired.

Figure 4:
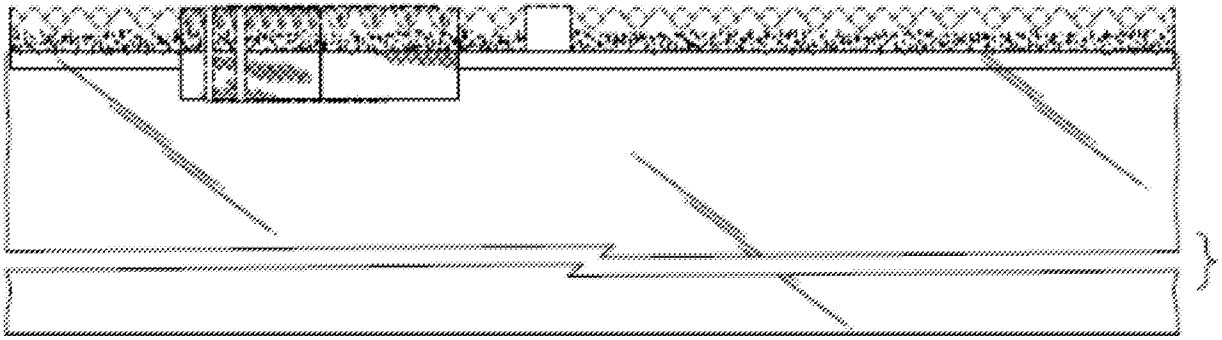
FIG. 4 is a left side view of the stabilization device shown in FIG. 1.

The stabilization device (100) can be secured to the OR via straps (40) extending around the main body portion, as shown in FIG. 1. The straps (40) can be sized with sufficient length to allow the strap to loop around a hospital bed, operating room table or gurney, or wrap around the rails on the side of the bed, table or gurney as shown in FIGS. 1, 2 and 4. This allows for more precise positioning and inhibits relative movement between the stabilization device and the bed.

Additionally, the stabilization device (100) can be formed as two (or more) layers that are stacked together with an infection control harrier material (13) positioned between the layers (see FIG. 4). The infection control barrier material (13) can be formed from a variety of materials, as discussed above, and be formed either as a contiguous sheet (i.e. no apertures) or with apertures for securing the infection control barrier (13) to the adjacent layers (12, 14) or directly to the OR table. The infection barrier control material (113) can be sized to extend beyond the boundaries of the layers (110) forming the stabilization device, as shown in FIG. 5. As shown in the exemplary embodiment of FIG. 5, the infection barrier control material (113) can be positioned between layers (112, 114) and extend beyond the main body portion (110), with the arm board portions (120, 130) free of the infection barrier control material (113) (though the sleeve portion (126, 136) can serve a similar function as infection barrier control material (113)).

Additionally, or alternatively, the infection barrier control material (113) can be formed from a plurality of segments that are positioned adjacent, offset or in overlapping manner. For example, and as shown in FIG. 9, the infection barrier control material (113) is comprised of three segments (113*a*, 113*b*, 113*c*) which are positioned in an overlapping manner in that the superior/inferior edges of middle segment (113*b*) overlay (or underlie) the adjacent segments (113*a*, 133*c*). The superior and inferior edges of the segments can be bonded together, while the lateral edges remain free from bonding. This allows a physician to laterally fold/roll up a given segment to access the OR table and/or any controls or instruments positioned next to the table while allowing the superior and inferior edges to remain flat thereby providing infection barrier along the entire length of the patient. Also, the segments can be offset with respect to a longitudinal centerline of the device "c" as shown in FIG. 9, wherein the lateral edge 113*b*' of one segment is displaced closer to the main body portion 110 than the lateral edge 113*a*' of the adjacent segment. Accordingly, the infection barrier control material (113) can be formed as a plurality of discrete segments, as shown in FIG. 9. In some embodiments, the infection barrier control material (113) can be formed as a single unitary member with slits or perforations at select locations which extend less than an entirety of the width of material (113). These slits allow relative positioning/overlapping of the perforated ends.

Figure 7:
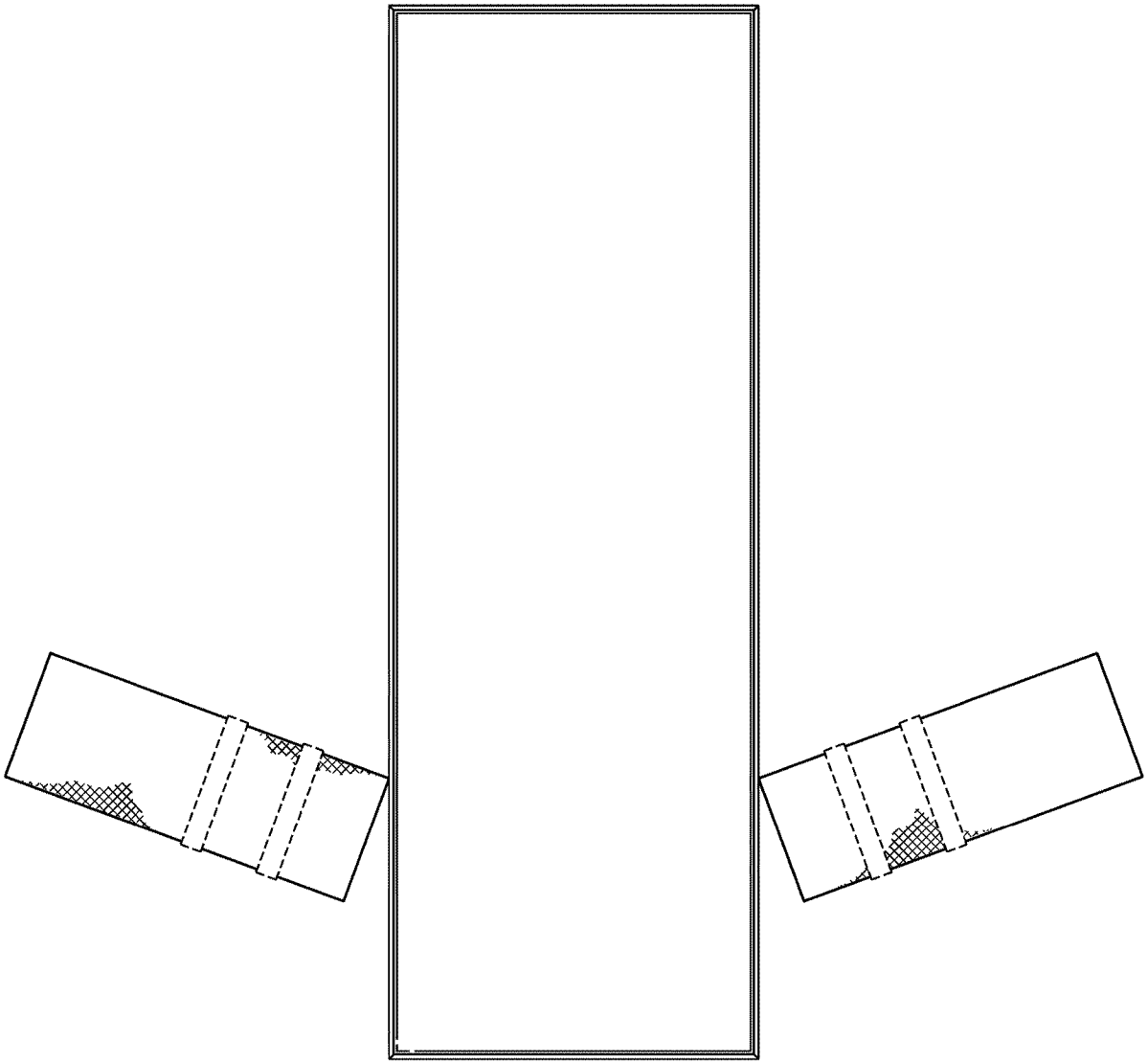
FIG. 7 is a bottom view of the stabilization device shown in FIG. 1.
Figure 8:
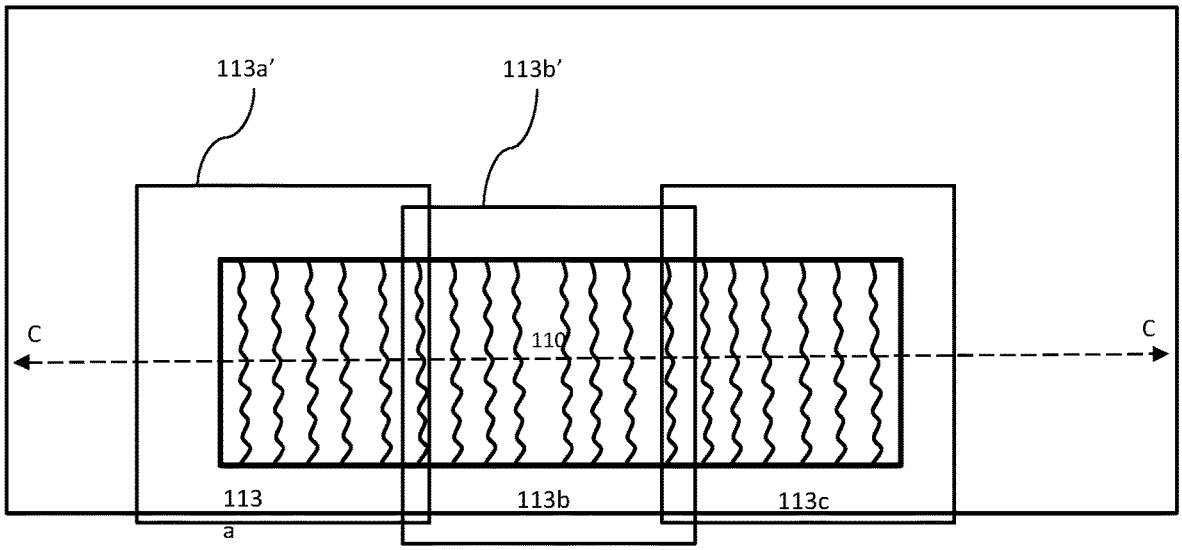
FIG. 8 is a schematic representation of a top view of the stabilization device, depicting the infection barrier in three, overlapping and offset segments.

In accordance with another aspect of the disclosure, the patient stabilization device, whether a single integral unit or formed from a plurality of discrete components, can be packaged in a condensed manner. FIG. 7 depicts an exemplary embodiment of the patient stabilization device in the rolled/folded configuration for compact storage/shipping. FIG. 8 depicts the unrolled/unfolded view with arm board sleeve portions (120, 130) shown as separate components temporarily positioned in the middle of the main body portion (110) for compact packaging. Similarly, the infection barrier control material (113), which can be sized to extend beyond the boundaries (e.g. in some instances by up to a distance of approximately 4 feet in any particular dimension) of the main body portion (110) is also folded so that its edges coincide with the main body portion (110), as shown in FIG. 8.

In the exemplary embodiment of FIG. 4, the top layer (12) of the stabilization device is configured with a greater thickness than the lower layer (14), though alternative dimensions are within the scope of the present disclosure. Moreover, the layers (12, 14) can be releasably attached so that a user can remove and replace a single layer, if so desired. The layers (12, 14) can further be formed with slots or channels (not shown) passing transversely from one lateral edge to the opposing lateral edge. These slots or channels are advantageous in that they allow for the cords of various OR equipment to be passed through the stabilization device (under the patient) and thus provide increased flexibility in OR equipment layout, and enhanced safety by removing the risk of interfering with the patient. In embodiments having the slots/channels, the top layer (12) of the stabilizing device can be formed with sufficient thickness and/or rigidity to prevent deformation which compromises the shape of the slots channels. Additionally, a reinforcing material can line the interior of the slots/channels to provide rigidity to prevent undesired deformation which could pinch or kink any wires/cords of the OR equipment which are positioned within the slots/channels.

In some embodiments the slots/channels can also include a heating or cooling network of channels, pockets, tubes or wires. Similarly, the top layer (12) of the stabilization device can incorporate thermally conductive material within the pressure distribution features to facilitate the localized heating/cooling of the patient.

In another embodiment, the stabilization device can be configured for use with lower extremity stirrups (not shown), wherein the main portion (10) includes a perineal cutout or recess and at least one layer of material having pressure distribution features as described herein. In such embodiments, the device can be sized and shaped to extend over leg portions received within the stirrups (and further include additional straps to secure the device to the stirrups). The leg portion of the device can be wrapped around the legs of the patient and include a thermal element. These leg portions, and any equipment (e.g. heating element, etc.) contained therein, can be formed with sufficient flexibility to allow for compression of the patient's lower legs. Further, an inflatable member can be included which serves as a Sequential Compression Device which can be repeatedly inflated/deflated to facilitate circulation and prevent formation of blood clots (in addition to the prevention of pressure ulcer formation as described above). This inflatable member also has the ability to heat and cool the lower extremities providing both deep vein thrombosis prevention and temperature regulation while also preventing skin breakdown and pressure ulcer formation.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A patient position device comprising:

a main body portion, the main body portion having:

a first layer having a plurality of pressure distribution features, a second layer disposed beneath the first layer, a layer of infection barrier material disposed between the first and second layer;

wherein the main body portion is configured as a general planar support having opposed superior and inferior edges, opposed left and right lateral edges and opposed top and bottom surfaces, and the layer of infection barrier material has opposed superior edge and inferior edges, opposed left and right lateral edges and opposed top and bottom surfaces, and the layer of infection barrier material extends laterally beyond the left and right lateral edges of the main body portion, with the opposed lateral edges of the infection barrier material free from bonding;

a pair of arm portions, wherein:

at least one arm portion is adapted to extend laterally from the main body portion, at least one arm portion includes a layer having a plurality of pressure distribution features;

at least one arm portion includes a sleeve, the sleeve having an open end and a closed end; and at least one strap, the strap including at least one fastener.

2. The device of claim 1, Wherein the layers each have unique characteristics.

3. The device of claim 1, wherein the strap includes hook and loop fasteners and is configured to engage an operating room table.

4. The device of claim 1, wherein at least the main body portion comprises convoluted polyurethane foam.

5. The device of claim 1, wherein the infection barrier material is an impervious barrier extending beyond the edges of the main body portion.

6. The device of claim 1, further comprising a thermal element configured to alter the temperature of at least a portion of the patient.

7. The device of claim 6, wherein the main body portion defines a thermal element retainer and the thermal element is securely retained in the thermal element retainer.

8. The device of claim 7, wherein the thermal element retainer is a sealable pocket.

9. The device of claim 6, wherein the thermal element is aligned with a kidney and/or a ureter of the patient when the patient is supine on the body portion, and the patient's shoulders are aligned with the superior edge of the body portion.

10. The device of claim 1, wherein the layer of infection barrier material is configured as a plurality of segments, each having a superior edge and inferior edge and lateral edges, with the superior edges of adjacent segments bonded together while the lateral edges of adjacent segments unbounded to each other.

11. The device of claim 1, wherein at least a portion of the layer of infection barrier material remains exposed to gain access to an operating room table disposed beneath the patient positioning device.

12. The device of claim 11, wherein the exposed portion of the layer of infection barrier material extending laterally beyond the left and right lateral edges of the main body portion is configured to be rolled up.

* * * * *